US008129645B2

(12) United States Patent
Siddeeq

(10) Patent No.: US 8,129,645 B2
(45) Date of Patent: Mar. 6, 2012

(54) DYNAMICALLY SELF-STABILIZING ELASTIC KEYSWITCH

(75) Inventor: Shakoor N. Siddeeq, Indianapolis, IN (US)

(73) Assignee: QuadTri Technologies, LLC, Indianapolis, IN (US)

( * ) Notice: Subject to any disclaimer, the term of this patent is extended or adjusted under 35 U.S.C. 154(b) by 552 days.

(21) Appl. No.: 12/270,106

(22) Filed: Nov. 13, 2008

(65) Prior Publication Data

US 2009/0120774 A1 May 14, 2009

Related U.S. Application Data

(60) Provisional application No. 61/002,815, filed on Nov. 13, 2007.

(51) Int. Cl.
*H01H 1/10* (2006.01)

(52) U.S. Cl. ..... 200/517

(58) Field of Classification Search ..... 200/5 A, 200/314, 341, 512, 517
See application file for complete search history.

(56) References Cited

U.S. PATENT DOCUMENTS

| | | | | |
|---|---|---|---|---|
| 4,390,765 | A | 6/1983 | Sado et al. | |
| 4,554,426 | A | 11/1985 | Caste | |
| 4,803,321 | A | 2/1989 | Lefebvre | |
| 5,399,821 | A * | 3/1995 | Inagaki et al. | 200/341 |
| 6,180,895 | B1 * | 1/2001 | Hutchinson et al. | 200/5 A |
| 6,977,352 | B2 * | 12/2005 | Oosawa | 200/314 |
| 7,094,979 | B2 | 8/2006 | Kurokawa et al. | |
| 2006/0131156 | A1 | 6/2006 | Voelckers | |
| 2008/0006516 | A1 | 1/2008 | Nishino et al. | |

* cited by examiner

*Primary Examiner* — Edwin A. Leon
(74) *Attorney, Agent, or Firm* — Michael Dryja

(57) ABSTRACT

A dynamically self-stabilizing elastic keyswitch for a key of a keyboard includes a rigid keytop, a thin elastic sheet, and a downward-facing convex rigid key bottom. The rigid keytop has a central axis at least substantially perpendicular to a surface of the rigid keytop. The thin elastic sheet is disposed relative to the central axis, and the central axis is at least substantially perpendicular to a surface of the thin elastic sheet. The downward-facing convex rigid key bottom is disposed relative to the central axis and below the rigid keytop, and the central axis is at least substantially perpendicular to a surface of the downward-facing convex rigid key bottom.

11 Claims, 2 Drawing Sheets

DYNAMICALLY SELF-STABILIZING ELASTIC KEYSWITCH

RELATED PATENT APPLICATIONS

The present patent application claims priority to the previously filed and copending provisional patent application entitled "Dynamically self-stabilizing elastic keyswitch," filed on Nov. 13, 2007, and assigned application No. 61/002,815.

TECHNICAL FIELD

The present invention generally relates to a keyswitch for a key of a keyboard, such as a computer keyboard like a laptop computer keyboard, and more specifically relates to such a keyswitch that is dynamically self-stabilizing and elastic.

BACKGROUND

Laptop computers, which are also referred to as notebook computers, include integrated keyboards and integrated displays. As such, a laptop computer is a single computing device that permits a user to input information via the integrated keyboard and to receive information via the integrated display. A design goal with many types of laptop computers has been to decrease their dimensional size, such as the thickness of such laptop computers.

One part of decreasing the thickness of a laptop computer is to employ a relatively thin integrated keyboard. However, it is still desirable to maintain a relatively high key travel, which is the distance that a given key physically moves perpendicular to the keyboard when depressed by a user. Relatively high key travel permits a laptop computer keyboard to mimic the tactile feel of a standalone computer keyboard commonly attached to desktop computers.

A difficulty with maintaining relatively high key travel of relatively thin laptop computer keyboards is that the keys are prone to wobble or tilt. Wobble and tilt are undesirable, as they qualitatively degrade the user experience of typing on the keyboard. As such, users are not as likely to enjoy typing on the keyboard, and the users are likely to not be able to type as quickly on the keyboard as compared to standalone computer keyboards.

One way to minimize wobble and tilt is to employ a rigid scissor-type keyswitch arrangement, which permits balanced key travel during key presses. However, scissor keyswitches are typically manufactured using a number of separate pieces via expensive injection-molding techniques, and thereafter require complex assembly. As such, scissor keyswitches are not amenable to inclusion within relatively inexpensive laptop computers, where the cost of their keyswitches is prohibitive.

SUMMARY

A keyboard of an embodiment of the invention includes a number of keys. Each key includes an elastic keyswitch, a rigid keyboard base, a switching mechanism, and a printed circuit board. Each elastic keyswitch includes a rigid keytop, a thin elastic sheet, and a downward-facing convex rigid key bottom. The rigid keytop has a central axis at least substantially perpendicular to a surface of the rigid keytop. The thin elastic sheet is disposed relative to the central axis, which is at least substantially perpendicular to a surface of the thin elastic sheet. The downward-facing convex rigid key bottom is disposed below the rigid keytop and relative to the central axis, which is at least substantially perpendicular to a surface of the downward-facing convex rigid key bottom.

The rigid keyboard base has a number of raised endpoints that define a perimeter. The thin elastic sheet is pulled and tightly attached in multiple directions about this perimeter. The switching mechanism is disposed between the rigid keyboard base and the downward-facing convex rigid key bottom. The printed circuit board is disposed between the rigid keyboard base and the switching mechanism. The printed circuit board registers actuation of the key in question, responsive to the switching mechanism coming into contact with the printed circuit board.

Furthermore, in one embodiment, each elastic keyswitch is responsive to a force off-axis to the central axis such that the switching mechanism initially begins to tilt and/or rotate about the central axis. However, the thin elastic sheet dynamically minimizes the rotational force about the central axis while still simultaneously permitting a downward component of the force to continue along the central axis. Additionally, the downward-facing convex rigid key bottom is decoupled from a top of the switching mechanism.

The curvature of the downward-facing convex rigid key bottom together with this decoupling permit the downward-facing convex rigid key bottom to rotate and/or tilt upon the switch mechanism while minimizing buckling effects on the switching mechanism. Furthermore, the convex rigid key bottom acts to raise the center of mass of the elastic keyswitch in question to permit the rigid keytop to tilt and/or rotate about the central axis without one or more edges of the rigid keytop coming into contact with the rigid keyboard base.

In these ways, therefore, the elastic keyswitch is dynamically self-stabilizing, such that wobble and/or tilt are minimized, without having to employ a scissor mechanism as in the prior art. The elastic keyswitch can advantageously be made relatively thin. The elastic keyswitches can utilize elastic materials and reduced numbers of constituent components as compared to rigid scissor-type keyswitches within the prior art, such that the elastic keyswitches are cheaper to manufacture from a cost perspective and are also easier to assemble, which also contributes to cost savings.

Still other aspects, advantages, and embodiments of the invention will become apparent by reading the detailed description that follows, and by referring to the accompanying drawings.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
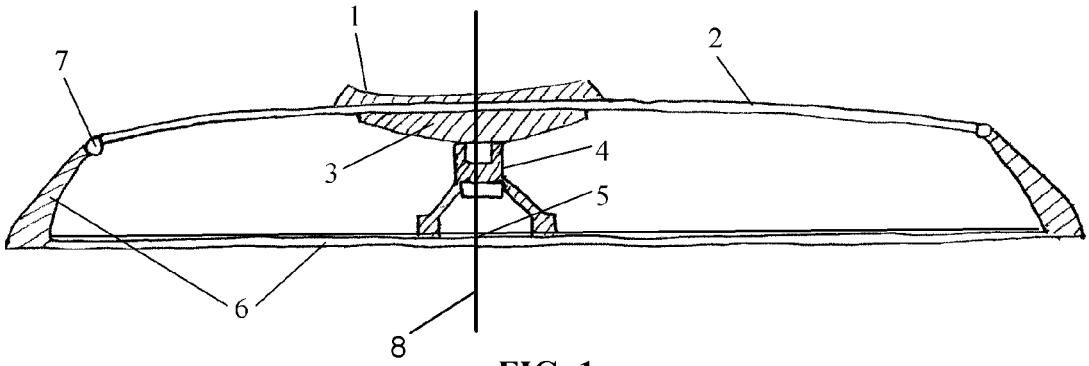
FIG. 1 is a diagram of a cross-sectional side view of a dynamically self-stabilizing elastic keyswitch, as part of a single key of a computer keyboard, according to an embodiment of the invention.
Figure 2:
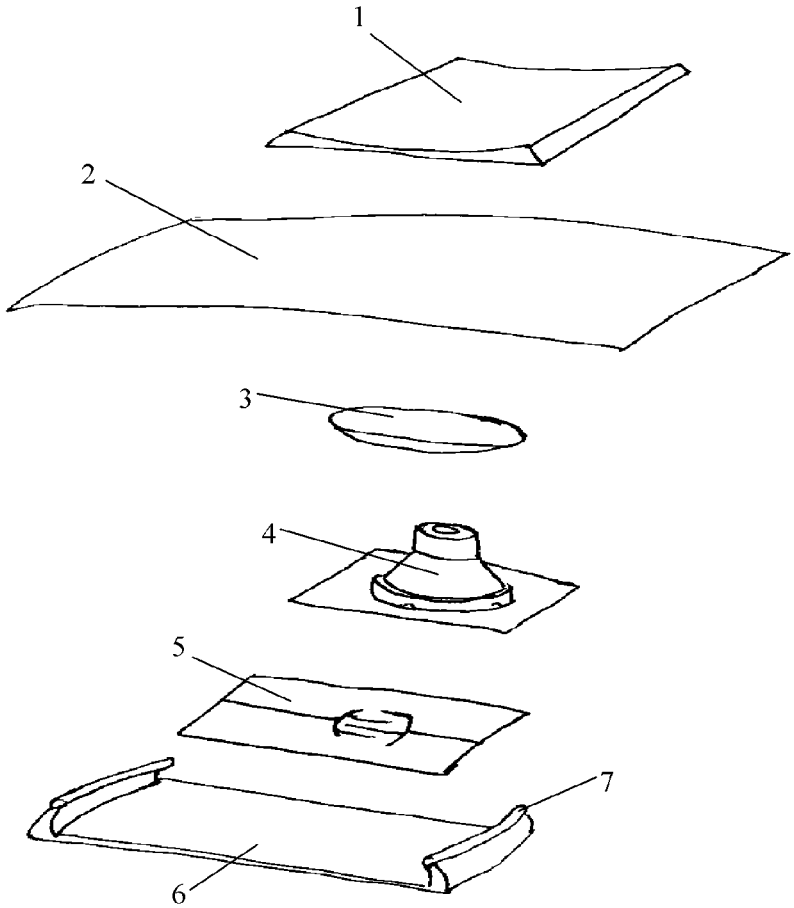
FIG. 2 is a diagram of an exploded perspective view of the keyswitch and key of FIG. 1, according to an embodiment of the invention.

FIG. 1 shows a cross-sectional side view of a dynamically self-stabilizing elastic keyswitch as part of a single key of a computer keyboard, and FIG. 2 shows an exploded perspective view of this keyswitch and key, according to an embodiment of the invention. A rigid keytop 1 is attached to a thin elastic sheet 2, which is attached to a downward facing convex rigid key bottom 3. The rigid keytop 1 has a central axis 8 that is at least substantially perpendicular to a surface of the rigid keytop 1, to a surface of the thin elastic sheet 2, and to a surface of the downward facing convex rigid key bottom 3. The rigid keytop 1, thin elastic sheet 2, and convex rigid key bottom 3 together make up the elastic keyswitch of FIGS. 1 and 2.

In one embodiment, the elastic keyswitch (i.e., the rigid keytop 1, the thin elastic sheet 2, and the convex rigid key bottom 3) is manufactured as a single integral multi-durometer elastomeric structure that has both rigid and elastic properties. In another embodiment, the rigid keytop 1 and the convex rigid key bottom 3 are combined into a single structure that is separate from a structure of the thin elastic sheet 2. In still another embodiment, the rigid keytop 1, the thin elastic sheet 2, and the convex rigid key bottom 3 are each a separate structure. The thin elastic sheet 2 may be attached to the top of the rigid keytop 1 or to the bottom of the convex rigid key bottom 3, and/or to the top or bottom of the single combined structure of the rigid keytop 1 and convex rigid key bottom 3.

The key of FIGS. 1 and 2 include the elastic keyswitch made up of the rigid keytop 1, the thin elastic sheet 2, and the convex rigid key bottom 3. The key further includes a rigid keyboard base 6, a printed circuit board 5, and a switching mechanism 4. The switching mechanism 4 is disposed between the rigid keyboard base 6 and the convex rigid key bottom 3. The printed circuit board 5 is disposed between the rigid keyboard base 6 and the switching mechanism 4.

The elastic keyswitch is depicted as being attached to a rigid keyboard base 6 via raised endpoints 7 of the rigid keyboard base 6. It is noted that that the raised endpoints 7 may be disposed about the entire perimeter of the rigid keyboard base 6, and thus fully surround the elastic keyswitch. The thin elastic sheet 2 of the elastic keyswitch in this embodiment is pulled and attached sufficiently tightly in multiple directions about the perimeter of the raised endpoints 7, so that the dynamic stabilization and/or elastic material properties of the elastic keyswitch does not interfere with the overall snap ratio and/or tactile feel of the switching mechanism 4.

The switching mechanism 4 may be a typical rubber keyswitch mechanism with carbon pill as is used in laptop computer keyboards. Pressing the rigid keytop 1 of the elastic keyswitch forces the rubber keyswitch 4 to depress and close the circuit on the flexible printed circuit board 5 to register a key press. That is, actuation of the key is registered by the printed circuit board 5 in response to the switching mechanism 4 coming into contact with the printed circuit board 5.

Embodiments of the invention reduce key wobble and/or tilt during key depression. When sufficient force is applied to any point away from the center point on the rigid keytop 1 of the elastic keyswitch such that the rubber keyswitch 4 begins to be depressed, the rigid keytop 1 initially begins to tilt and/or rotate about the central axis 8 that is centered in the plane of the top of the rubber keyswitch 4. However, the elasticity of the elastic sheet 2 dynamically acts to dissipate and/or slow down the rotational force about this axis while simultaneously allowing for downward force to continue along the central axis 8.

In addition to the dissipation and/or slowing down of the tilting and/or rotation of the rigid keytop 1 by the elastic sheet 2, the convex rigid key bottom 3 acts to raise the center of mass of the elastic keyswitch. This allows for a rigid keytop 1 of substantial width to rotate and/or tilt at a larger angle without the edges of the rigid keytop 1 coming into contact with the keyboard base 6. Furthermore, the downward convex curvature of the convex rigid key bottom 3, in conjunction with its decoupled state with respect to the top of the switching mechanism 4, allows for the convex rigid key bottom 3 to rotate and/or tilt with minimal buckling upon the switching mechanism 4. This preserves the tactile feel and/or snap ratio of the switching mechanism 4 despite any slight key wobbling or tilting of the elastic keyswitch during a key press.

Figure 3:
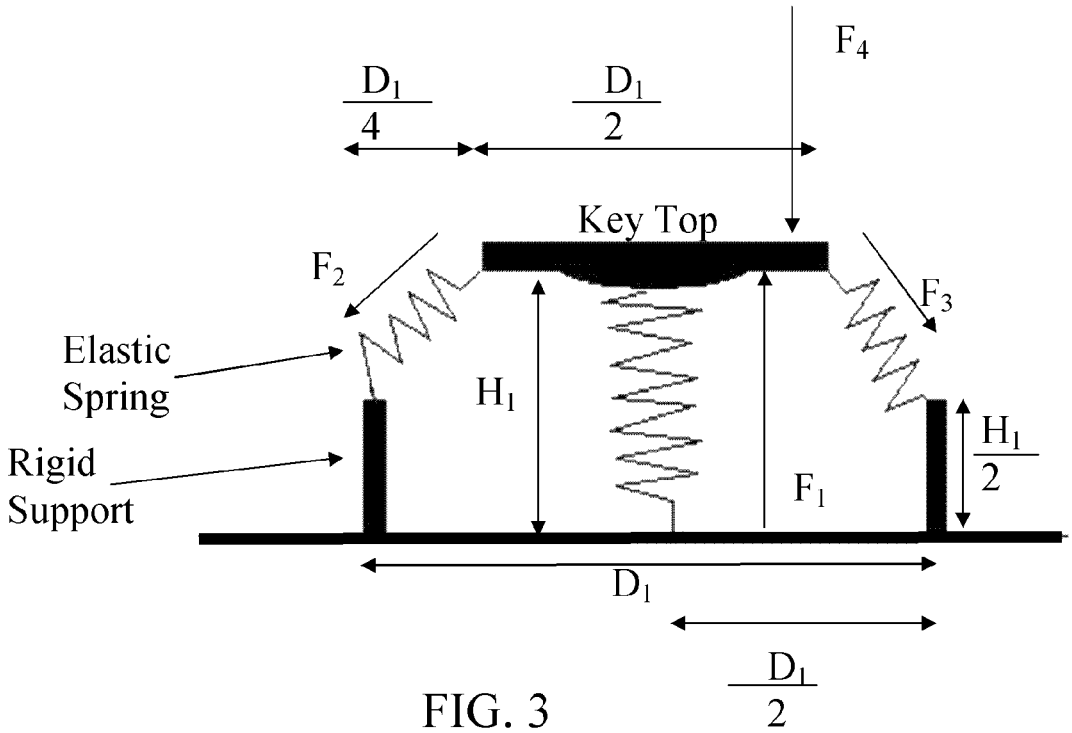
FIG. 3 is a diagram of a system model of a dynamically self-stabilizing elastic keyswitch, according to an embodiment of the invention.

FIG. 3 shows a system force model of the elastic keyswitch and key of FIGS. 1 and 2, according to an embodiment of the invention. The keyboard base 6 between the ends of its rigid supports has a width $D_1$, and the rigid keytop 1 has a width $D_1/2$. The rigid keytop 1 is centered over the keyboard base 6, such that there is distance $D_1/4$ to either side of the keytop 1 and the sides of the base 6 as defined by its rigid supports. The distance between the keyboard base 6 and the rigid keytop 1 is denoted as the height $H_1$, where the rigid supports of the base 6 have a height equal to $H_1/2$.

To actuate the key, a force greater than the spring force $F_1$ has to be applied downwards, which is denoted as the force $F_4$. It is noted that this force $F_1$ is greater than the resultant force of $F_2$ and $F_3$, where the forces $F_2$ and $F_3$ are elastic spring forces resulting from the thin elastic sheet 2 and the force $F_1$ is an elastic spring force resulting from the switching mechanism 4. It is also noted that the forces $F_2$ and $F_3$ are at non-zero angles to the central axis 8. The goal of the elastic keyswitch is to prevent the keytop 1 from rotating about its center (i.e., about the central axis 8) as it is depressed downward by an applied force $F_4$ at any point along the keytop 1. The thin elastic sheet 2 and the convex rigid key bottom 3 achieve this goal, as has been described above in relation to the reduction of wobble, tilt, and rotation.

Without the applied external force $F_4$, the system of FIG. 3 is in equilibrium. Furthermore, without the presence of the spring force $F_1$, both the elastic spring forces $F_2$ and $F_3$, as well as the rigid keytop 1 itself, would be at a horizontal equilibrium within a single plane at the height $H_1/2$. Therefore, the switching mechanism 4, which provides for the spring force $F_1$, permits greater key travel. At the same time, the thin elastic sheet 2 and the convex rigid key bottom 3 reduce wobble, tilt, and rotation of the rigid keytop 1 when the external force $F_4$, regardless of the point along the surface of the keytop 1 at which the external force $F_4$ is applied.

Figure 4:
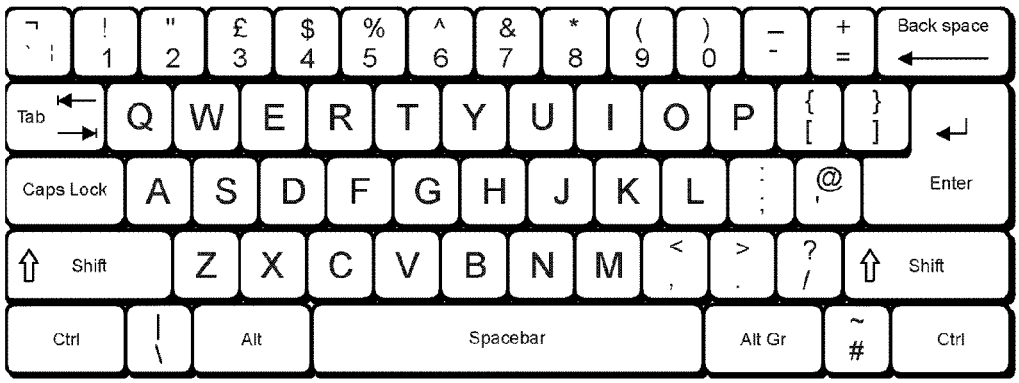
FIG. 4 is a diagram of a representative keyboard, according to an embodiment of the invention.

In conclusion, FIG. 4 shows a representative keyboard, according to an embodiment of the invention. The keyboard includes a number of keys, such as alphanumeric keys like "Q", "W", "E", "R", "T", "Y", "1", "2", "3", and so on. The layout of the keyboard is for exemplary purposes only, and those of ordinary skill within the art can appreciate that the keyboard can have a different layout including the same and/or different keys. Each of the keys of the keyboard of FIG. 4 can be implemented as has been described in relation to FIGS.

1, 2, and/or 3 above. That is, each of the keys can include a dynamically self-stabilizing elastic keyswitch as has been described.

It should be noted by those skilled in the art that the invention has been described with reference to a number of embodiments. The number, materials, operating mechanisms, properties, sizes, shapes, types, and other characteristics of the components that are not depicted or described are trivial and numerous variations of these exist which may be used to construct the device without changing the spirit and scope of the invention. As such, it is noted that, although specific embodiments have been illustrated and described herein, it will be appreciated by those of ordinary skill in the art that any arrangement calculated to achieve the same purpose may be substituted for the specific embodiments shown. This application is intended to cover any adaptations or variations of embodiments of the present invention. Therefore, it is manifestly intended that this invention be limited only by the claims and equivalents thereof.

I claim:

1. An elastic keyswitch for a key of a keyboard, comprising:

a rigid keytop having a central axis at least substantially perpendicular to a surface of the rigid keytop;

a thin elastic sheet disposed relative to the central axis, the central axis at least substantially perpendicular to a surface of the thin elastic sheet, the thin elastic sheet encircling the rigid keytop, an outer edge of the rigid keytop corresponding to an inner edge of the thin elastic sheet, the thin elastic sheet attached to a subset of a surface area of the rigid keytop;

a downward-facing convex rigid key bottom disposed relative to the central axis and below the rigid keytop, the central axis at least substantially perpendicular to a surface of the downward-facing convex rigid key bottom;

a spring-like actuator switch atop which the convex rigid key bottom sits, the spring-like actuator switch sitting atop a rigid base of the keyboard; and, a fixed rigid perimeter encircling the thin elastic sheet, an outer edge of the thin elastic sheet corresponding to and attached to an inner edge of the fixed rigid perimeter, a height of the spring-like actuator switch being greater than a height of the fixed rigid perimeter such that the inner edge of the thin elastic sheet is raised above the outer edge of the thin elastic sheet to define a height differential that induces tension in the thin elastic sheet in an unactuated state at rest, wherein the tension in the thin elastic sheet causing the thin elastic sheet to stretch to induce a downward force component about one or more of the fixed rigid perimeter and the surface area of the rigid keytop while the key is in the unactuated state at rest, the downward force component less than an upward force component of the spring-like actuator switch, and wherein when the rigid keytop is actuated by a downward applied external force greater than the upward force component of the spring-like actuator switch, the rigid keytop descends downward, such that as the rigid keytop is actuated by the downward applied external force and descends downward the tension in the thin elastic sheet dynamically decreases, such that the surface area of the thin elastic sheet encircling the rigid keytop dynamically decreases and pulls sides of the rigid keytop downward such that the rigid keytop is dynamically leveled and balanced in an actuated state.

2. The elastic keyswitch of claim 1, wherein the rigid keytop, the thin elastic sheet, and the downward-facing convex rigid key bottom are each a separate structure.

3. The elastic keyswitch of claim 1, wherein the rigid keytop, the thin elastic sheet, and the downward-facing convex rigid key bottom together are a single integral multi-durometer elastomeric structure having both rigid and elastic properties.

4. The elastic keyswitch of claim 1, wherein the rigid keytop and the downward-facing convex rigid key bottom are together a first structure, and the thin elastic sheet is a second structure separate from the first structure.

5. The elastic keyswitch of claim 4, wherein the thin elastic sheet is disposed above the first structure.

6. The elastic keyswitch of claim 4, wherein the thin elastic sheet is disposed below the first structure.

7. The elastic keyswitch of claim 1, wherein the thin elastic sheet is disposed between the rigid keytop and the downward-facing convex rigid key bottom.

8. The elastic keyswitch of claim 1, wherein the thin elastic sheet is disposed above the rigid keytop.

9. The elastic keyswitch of claim 1, wherein the thin elastic sheet is disposed below the downward-facing convex rigid key bottom.

10. A key of a keyboard comprising an elastic keyswitch comprising:

a rigid keytop having a central axis at least substantially perpendicular to a surface of the rigid keytop;

a thin elastic sheet disposed relative to the central axis, the central axis at least substantially pendicular to a surface of the thin elastic sheet the thin elastic sheet encircling the rigid keytop, an outer edge of the rigid keytop corresponding to an inner edge of the thin elastic sheet, the thin elastic sheet attached to a subset of a surface area of the rigid keytop;

a downward-facing convex rigid key bottom disposed relative to the central axis and below the rigid keytop, the central axis at least substantially perpendicular to a surface of the downward-facing convex rigid key bottom;

a spring-like actuator switch atop which the convex rigid key bottom sits, the spring-like actuator switch sitting atop a rigid base of the keyboard; and, a fixed rigid perimeter encircling the thin elastic sheet an outer edge of the thin elastic sheet corresponding to and attached to an inner edge of the fixed rigid perimeter, a height of the spring-like actuator switch being greater than a height of the fixed rigid perimeter such that the inner edge of the thin elastic sheet is raised above the outer edge of the thin elastic sheet to define a height differential that induces tension in the thin elastic sheet in an unactuated state at rest, wherein the tension in the thin elastic sheet causing the thin elastic sheet to stretch to induce a downward force component about one or more of the fixed rigid perimeter and the surface area of the rigid keytop while the key is in the unactuated state at rest the downward force component less than an upward force component of the spring-like actuator switch, and wherein when the rigid keytop is actuated by a downward applied external force greater than the upward force component of the spring-like actuator switch, the rigid keytop descends downward, such that as the rigid keytop is actuated by the downward applied external force and descends downward the tension in the thin elastic sheet dynamically decreases, such that the surface area of the thin elastic sheet encircling the rigid keytop dynamically decreases and pulls sides of the rigid keytop downward such that the rigid keytop is dynamically leveled and balanced in an actuated state.

11. A keyboard comprising a plurality of keys, each key comprising an elastic keyswitch comprising:

a rigid keytop having a central axis at least substantially perpendicular to a surface of the rigid keytop;

a thin elastic sheet disposed relative to the central axis, the central axis at least substantially perpendicular to a surface of the thin elastic sheet, the thin elastic sheet encircling the rigid keytop, an outer edge of the rigid keytop corresponding to an inner edge of the thin elastic sheet, the thin elastic sheet attached to a subset of a surface area of the rigid keytop;

a downward-facing convex rigid key bottom disposed relative to the central axis and below the rigid keytop, the central axis at least substantially perpendicular to a surface of the downward-facing convex rigid key bottom;

a spring-like actuator switch atop which the convex rigid key bottom sits, the spring-like actuator switch sitting atop a rigid base of the keyboard; and, a fixed rigid perimeter encircling the thin elastic sheet an outer edge of the thin elastic sheet corresponding to and attached to an inner edge of the fixed rigid perimeter, a height of the spring-like actuator switch being greater than a height of the fixed rigid perimeter such that the inner edge of the thin elastic sheet is raised above the outer edge of the thin elastic sheet to define a height differential that induces tension in the thin elastic sheet in an unactuated state at rest, wherein the tension in the thin elastic sheet causing the thin elastic sheet to stretch to induce a downward force component about one or more of the fixed rigid perimeter and the surface area of the rigid keytop while the key is in the unactuated state at rest the downward force component less than an upward force component of the spring-like actuator switch, and wherein when the rigid keytop is actuated by a downward applied external force greater than the upward force component of the spring-like actuator switch, the rigid keytop descends downward, such that as the rigid keytop is actuated by the downward applied external force and descends downward the tension in the thin elastic sheet dynamically decreases, such that the surface area of the thin elastic sheet encircling the rigid keytop dynamically decreases and pulls sides of the rigid keytop downward such that the rigid keytop is dynamically leveled and balanced in an actuated state.

* * * * *